US009554431B2

(12) United States Patent
Garrity et al.

(10) Patent No.: US 9,554,431 B2
(45) Date of Patent: Jan. 24, 2017

(54) LED DRIVER

(71) Applicant: Garrity Power Services LLC, Rockwall, TX (US)

(72) Inventors: Paul Garrity, Rockwall, TX (US); Aaron Jungreis, Ra'anana (IL)

(73) Assignee: GARRITY POWER SERVICES LLC, Rockwall, TX (US)

( * ) Notice: Subject to any disclaimer, the term of this patent is extended or adjusted under 35 U.S.C. 154(b) by 4 days.

(21) Appl. No.: 14/590,437

(22) Filed: Jan. 6, 2015

(65) Prior Publication Data

US 2015/0195878 A1 Jul. 9, 2015

Related U.S. Application Data

(60) Provisional application No. 61/924,101, filed on Jan. 6, 2014.

(51) Int. Cl.
*H05B 33/08* (2006.01)

(52) U.S. Cl.
CPC ..... *H05B 33/0815* (2013.01); *H05B 33/0821* (2013.01)

(58) Field of Classification Search
None
See application file for complete search history.

(56) References Cited

U.S. PATENT DOCUMENTS 5,003,454 A * 3/1991 Bruning ..... H02M 1/4225 323/222
9,270,185 B2 * 2/2016 McAuliffe ..... H02M 3/156
9,438,135 B2 * 9/2016 Kinoshita ..... H02M 7/537
2003/0117095 A1 * 6/2003 Gorti ..... H02P 6/085 318/275
2005/0067974 A1 * 3/2005 Trestman ..... H05B 41/28 315/224
2006/0152085 A1 * 7/2006 Flett ..... B60L 9/30 307/75
2008/0123373 A1 * 5/2008 Roesner ..... H02M 3/155 363/65
2010/0027304 A1 * 2/2010 Wang ..... H02M 7/219 363/126
2010/0034002 A1 * 2/2010 Ilic ..... H02M 3/1584 363/132
2010/0238690 A1 * 9/2010 Krein ..... H02J 3/1835 363/40

(Continued)

*Primary Examiner* — Crystal L Hammond
(74) *Attorney, Agent, or Firm* — Hovey Williams LLP

(57) ABSTRACT

An LED driver having an input to receive AC power from an AC power source, a semiconductor switch and an inductor controlled to produce a sinusoidal current drawn from the AC power source, and a large non-electrolytic (e.g. film) capacitor energy storage component. The semiconductor switch operates with a varying pulse-width-modulation frequency to regulate the voltage across the non-electrolytic capacitor energy storage component in such a way that a ripple current through the inductor is substantially smaller than a pulse-width-modulation cycle average current through the inductor. A DC-to-DC converter couples the energy from the non-electrolytic energy-storage capacitor to an LED string. A feedback loop allows the LED string to be regulated in either constant current mode or constant power mode and information for the feedback regulation is fed back across a high-voltage boundary using a low-cost signal transformer.

15 Claims, 7 Drawing Sheets

(56) References Cited

U.S. PATENT DOCUMENTS

| | | | | |
|---|---|---|---|---|
| 2010/0265745 | A1* | 10/2010 | Xu | H02M 1/4258 363/126 |
| 2011/0140630 | A1* | 6/2011 | Doudousakis | H02M 3/156 315/291 |
| 2011/0298305 | A1* | 12/2011 | Chisenga | H02M 3/156 307/151 |
| 2012/0025720 | A1* | 2/2012 | Chen | H02M 3/337 315/185 R |
| 2012/0081933 | A1* | 4/2012 | Garrity | H02M 7/4807 363/37 |
| 2012/0081934 | A1* | 4/2012 | Garrity | H02M 7/46 363/37 |
| 2012/0098442 | A1* | 4/2012 | Jin | H05B 33/0827 315/188 |
| 2012/0126713 | A1* | 5/2012 | Horino | H02M 1/4225 315/187 |
| 2012/0212143 | A1* | 8/2012 | Esaki | H05B 33/089 315/192 |
| 2012/0262082 | A1* | 10/2012 | Esaki | H05B 33/0848 315/224 |
| 2013/0094261 | A1* | 4/2013 | Kern | H02J 3/383 363/98 |
| 2013/0176753 | A1* | 7/2013 | Swamy | H02M 1/4216 363/37 |
| 2013/0271021 | A1* | 10/2013 | Elferich | H02M 1/4258 315/206 |
| 2013/0300310 | A1* | 11/2013 | Hu | H05B 33/0854 315/239 |
| 2013/0313974 | A1* | 11/2013 | Fan | H05B 33/0815 315/127 |

* cited by examiner

LED DRIVER

RELATED APPLICATIONS

This non-provisional application claims priority to U.S. Provisional Patent Application Ser. No. 61/924,101 filed on Jan. 6, 2014, titled "LED Driver," which is herein incorporated by reference in its entirety. This application and the Provisional patent application have at least one common inventor.

FIELD OF INVENTION

This invention generally relates to AC-to-DC power converters. In particular, this invention relates to LED drivers.

BACKGROUND

Light emitting diode (LED) lighting is a fast growing industry due to the high efficiency and long life of LEDs. One difficulty of using LEDs stems from the large mismatch between the alternating current (AC) mains voltage, typically in the range of 100 VAC-277 VAC and the voltage of a single LED which is typically on the order of 1-2V. Another difficulty stems from the range of LED voltages as a function of temperature, manufacturer tolerances, and different manufacturer specifications. Still, another difficulty stems from the fact that LEDs are (direct current) DC devices whereas the primary source of power is AC.

The LED voltage mismatch may be reduced by using long series strings of LEDs. However, this only alleviates part of the issue since it is typically not feasible to place so many LEDs in series to match the AC mains voltage. Furthermore, placing devices in series only partly addresses the issue of voltage matching and does not address the issue of AC-to-DC mismatch or LED voltage variation.

A simple, low-cost solution is to place a large value resistor and a high-voltage diode in series with the LED string. However, this solution is very inefficient, has lifetime issues due to the heating of the resistor, and also leads to a very poor utilization of the available LED power due to the extremely high ripple current produced by the LED.

Many AC-to-DC drivers have been proposed and brought to market to address the issues of driving an LED. One such driver is discussed in U.S. Pat. No. 6,304,464 which proposes a flyback converter as an LED driver and represents the power conversion method used in the majority of AC-to-DC LED drivers which are on the market. While this typical type of driver provides a DC voltage to the LED, these driver types suffer from several drawbacks. One drawback of these drivers is the use of limited-lifetime components which gives the driver a much lower effective lifetime than the LED itself. The limited lifetime components include electrolytic capacitors used as the main storage element and optocouplers used in the feedback loop. These low-lifetime components not only reduce the cost-effectiveness of the overall LED solution, but they also limit the applications to use over relatively small temperature variations. A further drawback of these LED drivers is their inability to provide a lighting solution which provides a specific light level across temperature and manufacturing tolerance variations. Typically, LED drivers regulate the voltage across the LED string. The current is therefore determined by the forward voltage drop of the LEDs and the resistance of the LEDs. Small changes in LED voltage can lead to a large change in LED current and consequently to a large change in light output.

High-power drivers, such as those above 75 W in power, usually incorporate power factor correction on the input. Standard power factor correction circuits use either fixed-frequency continuous-conduction-mode pulse-width-modulation or variable-frequency critical-conduction-mode pulse-width-modulation. Fixed-frequency continuous-conduction-mode pulse-width-modulation typically requires expensive controllers, very large inductors, and large EMI filtering components to reduce the noise created at the single pulse-width-modulation frequency. Furthermore, fixed-frequency controllers can have high switching losses since the frequency is held constant regardless of the waveform amplitude. On the other hand, variable-frequency critical-conduction-mode pulse-width-modulation is inefficient due to the very high ripple current produced in the inductor, and therefore also requires large filters to reduce electro-magnetic-interference (EMI).

FIG. 1 shows a typical circuit of a prior art LED driver. This prior art driver contains AC filter 110, diode bridge 120, flyback converter 160, optional DC EMI filter 140, and output LED string 150. Flyback converter 120 contains storage electrolytic capacitor C101, semiconductor switch S101, transformer TX101, output diode D105, output electrolytic capacitor C102, controller C130, and a feedback circuit made up of components U101, Z101, and R101. Some type of energy storage such as storage electrolytic capacitor C101 is required in any LED driver because the output power is DC while the input power is AC pulsating at double the frequency of the input voltage.

Traditional converters use an electrolytic storage capacitor for several reasons including the following: 1) Electrolytic capacitors are relatively inexpensive compared to most other types of capacitors for a given value of the product of capacitance and voltage rating. 2) The large capacitance of electrolytic capacitors allows significant reduction of ripple voltage and can therefore be used to provide a relatively constant output voltage. 3) The small size of electrolytic capacitors provides the ability to make relatively small drivers.

The prior art converter illustrated in FIG. 1 operates as follows: The AC line charges C101 through diode bridge 120 to a voltage equal to the peak of the AC line voltage. The current drawn from the AC line is very large near the peak and trough of the line voltage and is zero otherwise (aside from a small current that may be drawn by AC EMI filter 110). Switch S101 is controlled with constant frequency pulse-width-modulation to charge the magnetizing inductance of transformer TX101 and then discharge the magnetizing inductance of transformer TX101 through diode D105 and output electrolytic capacitor C102. When C102 charges to the target value of output voltage, Z101 begins to conduct and turns on U101 to throttle back the pulse-width-modulation duty cycle through controller 130. The converter thus produces a constant output voltage. LED string 150 can be modeled as a constant voltage drop in series with a resistor, for input voltages that are greater than the LED turn-on voltage. The LED current is thus equal to the difference between the output voltage and the LED string turn-on voltage, divided by the LED equivalent resistance.

While this prior art converter in FIG. 1 offers a very inexpensive alternative to drive LED strings, it also has many limitations and drawbacks. The drawbacks include the following: 1) Output power varies significantly with LED string voltage. The light level will therefore change substantially depending on LED voltage tolerance, LED temperature, and tolerances in the circuit that regulate the output voltage. 2) Electrolytic capacitors C101 and C102 have a very limited lifetime which will typically be much less than the lifetime of the LED string. This lifetime issue can significantly impact the cost-effectiveness of the LED solution to replace other type of lighting, particularly in higher temperature applications where the electrolytic capacitor lifetime will be even lower. 3) Optocoupler U101 also has a limited lifetime causing the same issues as the limited lifetime of the electrolytic capacitor. 4) The electrolytic capacitor and optocoupler will limit operation of the LED driver to indoor applications due to temperature limitations of both parts. 5) The high pulse currents drawn by the input charging circuit cause significant distortion of the input current and are only allowed for small converters (e.g. below 75 W). 6) Isolated converters such as flyback converters tend to have a relatively low efficiency. Most pulse-width-modulation converters that must adjust the output voltage for changes in the input voltage suffer from higher losses compared with converters that do not regulate output voltage versus input voltage.

FIG. 2 illustrates another prior art LED driver. The driver shown in FIG. 2 is similar to the one shown in FIG. 1, except for the addition of power-factor-correction stage 210 formed by components L201, D205, and S201. The controller 230 operates semiconductor switch S201 in such a way as to draw a sinusoidal current from the AC source. Such converters are well known in the industry and used for higher power converters. Addition of the power-factor-correction converter solves only the issue of high pulse currents and distortion in the grid current, without addressing the other issues. Furthermore, typical methods of operating power-factor-correction converters create additional issues.

Specifically power-factor-correction converters are typically operated in one of two basic control methodologies. The first basic control methodology is referred to herein as critical conduction mode, in which the current through switch S201 is ramped up to a current proportional to the input voltage, and then commutated to D205 when the semiconductor switch is turned off. When the current through L201 decays to zero, switch S201 is then turned on again. The net result is an average current through L201 which is proportional to the input voltage. The frequency varies throughout the ac grid cycle. A great drawback to this control method is that the peak-to-peak ripple current through L201 is always twice as large as the instantaneous current that is drawn from the ac grid. Thus, L201 must be designed to saturate at nearly double the value of current at which it would otherwise be designed, there are large losses due to the high ripple current, and the AC EMI filter must be designed to filter out very large differential currents. This method is typically used for relatively low power power-factor-correction converters less than approximately 120 W due to the cost savings that occur from using a diode D205 which may have some recovery losses.

The second basic control methodology is referred to herein as continuous conduction mode. In this method of operation, switch S201 is operated at constant frequency pulse-width-modulation. However, the duty cycle is controlled to cause the current through L201 to be primarily sinusoidal in phase with the AC grid voltage. Some drawbacks to this method of control include the following: relative complexity of the control compared with the critical conduction mode method, similar ripple amplitude near the zero-crossings of the AC grid current compared with the peak of the grid current, thus causing increased harmonic distortion, and substantial EMI noise concentrated at multiples of the pulse-width-modulation frequency.

SUMMARY OF THE INVENTION

Embodiments of the present invention solve the above-mentioned problems and provide a distinct advance in the art of LED drivers. One embodiment of the invention provides an LED driver with an AC power source coupled to a first magnetic component with an inductance, which is further coupled to a first controllable semiconductor switch and to a DC bus comprising a film capacitor. The DC bus is further coupled to a string of LEDs, also referred to herein as an LED load. A first controller controls the first semiconductor switch in such a way as to draw a sinusoidal current from the AC power source and such that the film capacitor absorbs pulsating power from the power source and provides DC power to the LED string.

Embodiments of the present invention have the advantage of using only non-electrolytic storage elements and non-optical feedback components to provide a high lifetime product that can match and even exceed the lifetime of the LEDs. In an embodiment of the present invention, the film capacitor is sized such that the peak-to-peak AC ripple power in the LED load is greater than 20% of the steady-state power in the LED load.

In another embodiment of the present invention, the LED driver further comprises a non-regulated isolated DC-to-DC converter that functions as a DC transformer and is coupled to the DC bus and to the string of LEDs. In still another embodiment of the present invention, the LED driver further comprises a first controller that produces a first signal and a second signal. The first signal and second signal are rectified sinusoids with a DC offset and are in phase with each other such that the amplitude of the first signal is less than or equal to the amplitude of said second signal, and the sinusoidal portion of the second signal divided by the sinusoidal portion of the first signal is a constant over the course of each half-cycle of the ac power source.

Furthermore, the first controller compares the current flowing in the first magnetic component to the first signal and the second signal to determine whether to turn on the first controllable semiconductor switch in such a way as to either decrease or increase the current through the first magnetic component and in such a way as to produce a varying pulse-width-modulation frequency which decreases as the instantaneous value of the current increases, and which produces a value of AC ripple current which is smaller than the instantaneous value of the AC current. This advantageously allows use of an inexpensive controller, allows the user to easily trade switching losses for input current total harmonic distortion, and provides an easy method of control to provide a spread-spectrum EMI signature, thus reducing EMI signature at any specific frequency.

The LED driver may also adjust a first predetermined current level of an LED string as a function of LED voltage in such a way as to cause the power in the LED string to remain constant when the LED string voltage changes. This adjustment can be done, for example, by linearly reducing the predetermined current level with increasing LED string voltage. Furthermore, in some embodiments of the invention, the single-AC-power-cycle average value of inductance of the first magnetic component changes with load such that the average inductance value when operating at full load is less than 70% of the average inductance value when operating at 10% load. This variable inductance value may be enabled through a stepped air gap in the core of the first magnetic component.

In another embodiment of the invention, the controller may employ a multiplier which multiplies a reference sinusoidal signal by a multiplicand, such that the multiplicand changes at a slow rate compared with the frequency of the input power source and the multiplicand is increased when the current in the LED string is below the first predetermined current level, and the multiplicand is decreased when the current in the LED string is above the first predetermined current level. Furthermore, a first signal providing information about the comparison between the first predetermined current level and the LED string current is transmitted across a high-voltage isolation boundary using a first transformer, and the voltage at the LED side of the DC-to-DC power transformer is gated to produce the first signal.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
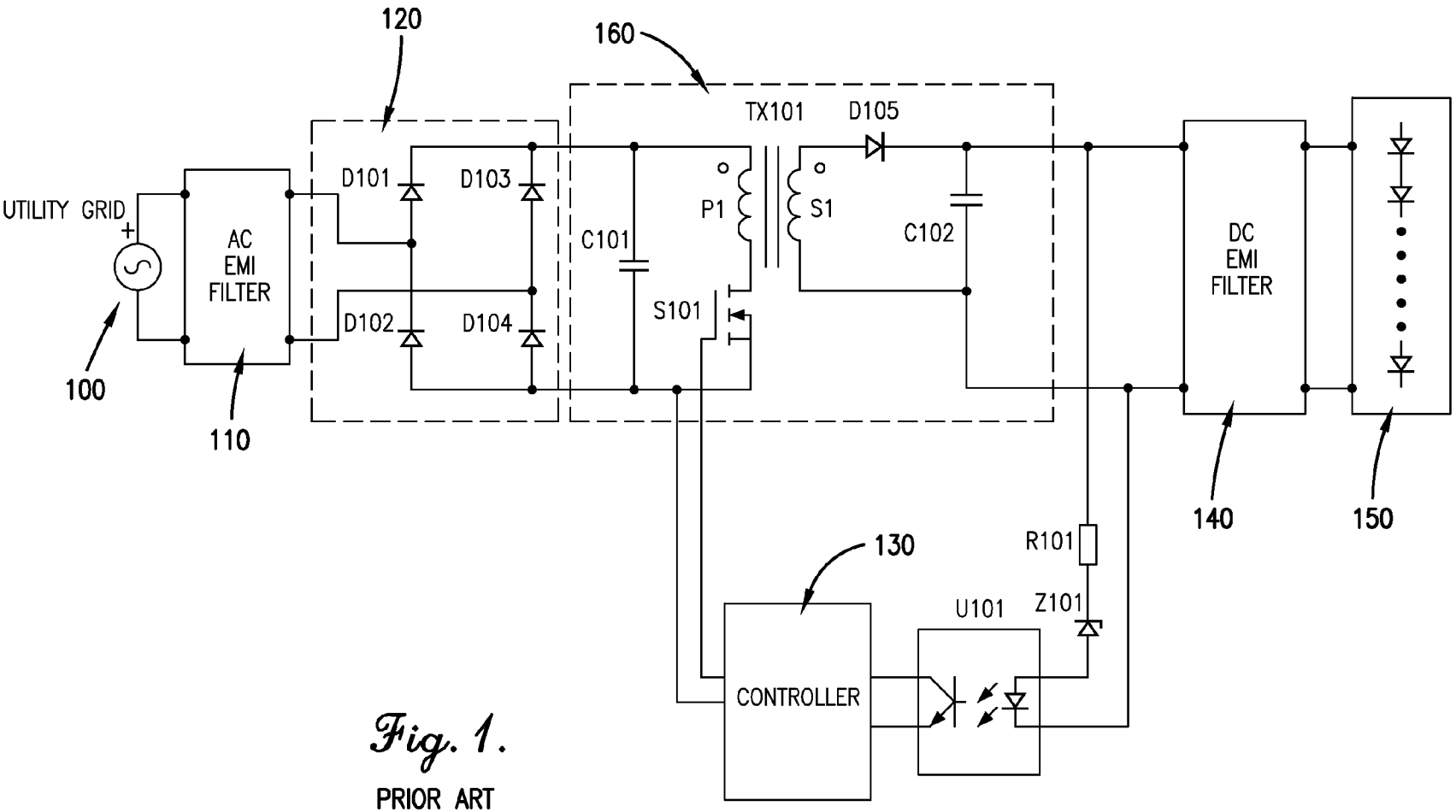
Fig. 1. PRIOR ART
FIG. 1 is a schematic drawing of a prior art LED driver that uses an electrolytic capacitor and regulates the LED string at constant voltage.
Figure 2:
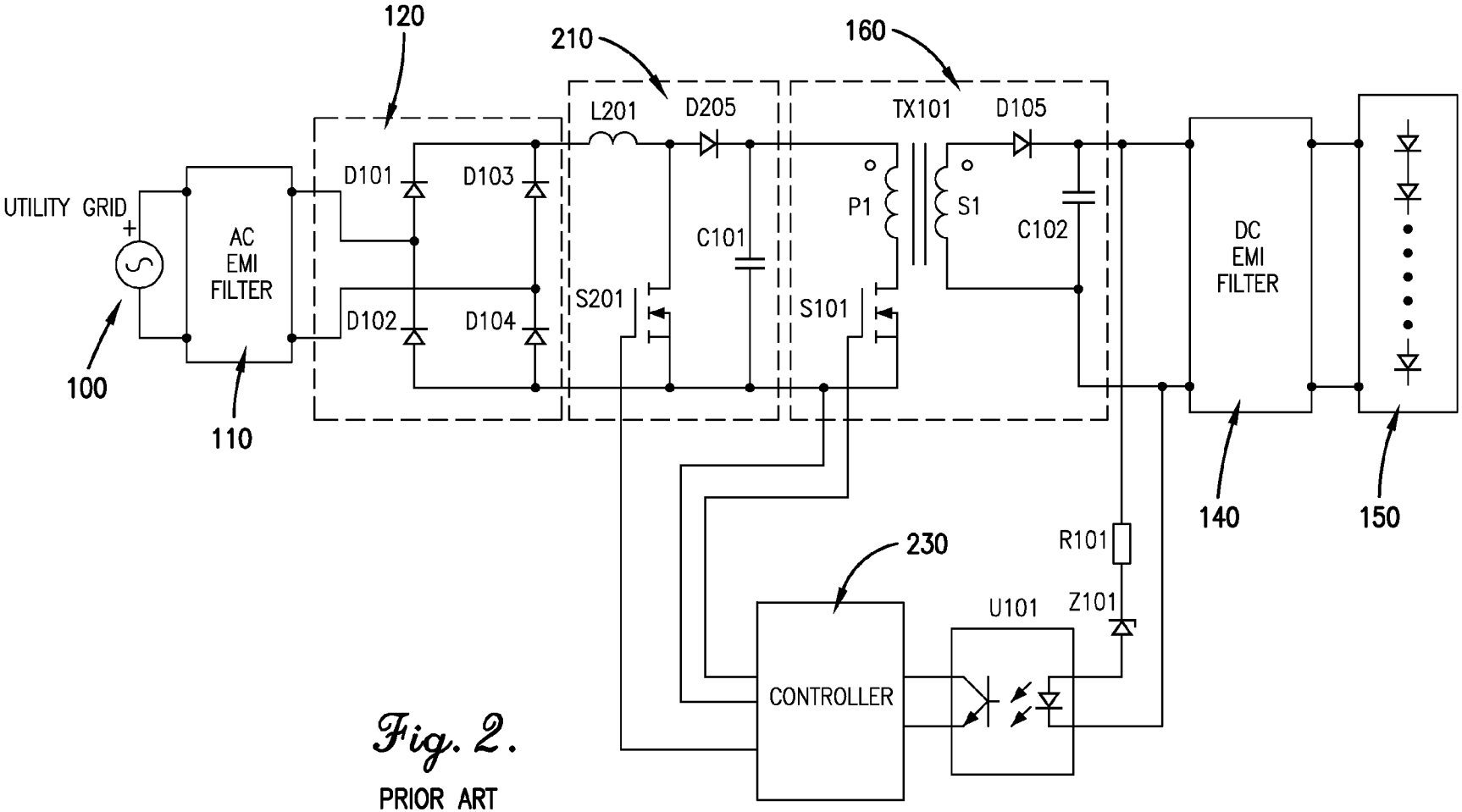
Fig. 2. PRIOR ART
FIG. 2 is a schematic drawing of a prior art LED driver that uses an electrolytic capacitor, regulates the LED string at constant voltage, and which draws nearly unity power factor from the AC mains.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 3:
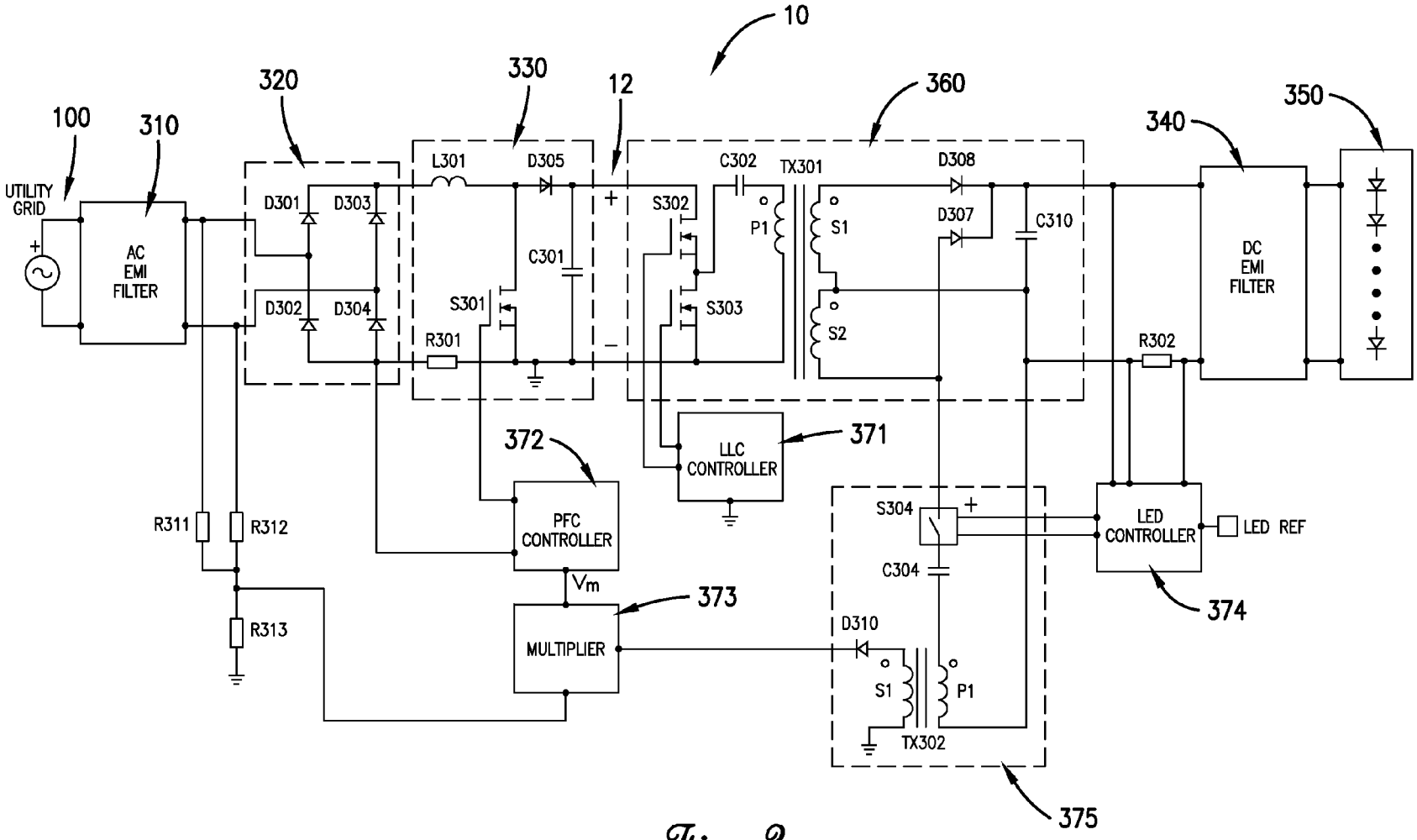
FIG. 3 is a schematic drawing of an LED driver constructed in accordance with embodiments of the present invention.
Figure 4:
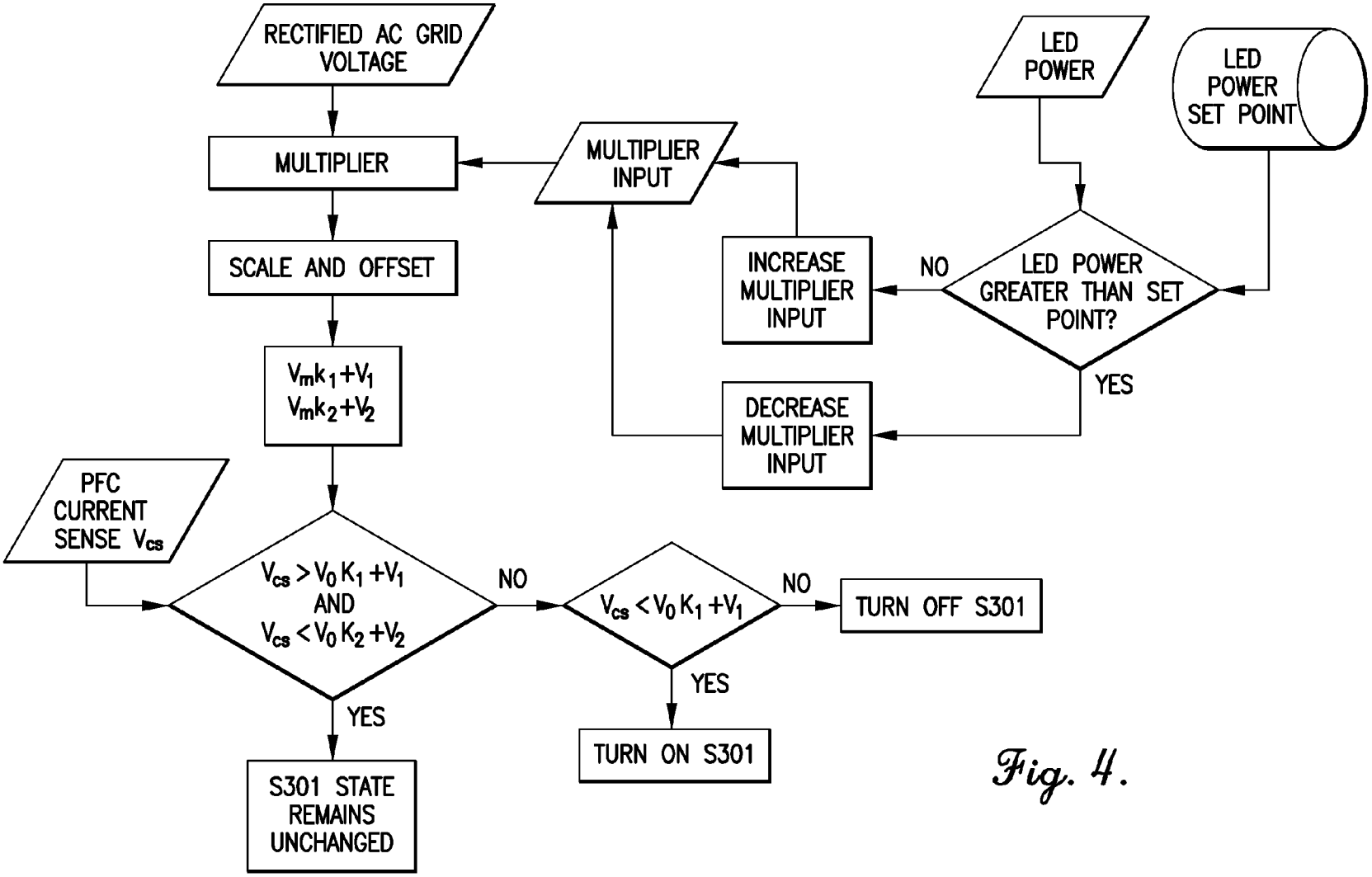
FIG. 4 is a flow chart illustrating a control algorithm for a power-factor-correction controller of the LED driver in FIG. 3.

A light emitting diode (LED) driver 10, constructed in accordance with embodiments of the present invention, is shown in FIGS. 3 and 4. Embodiments of the LED driver 10 are configured for driving one or more LEDs and converting AC voltage to DC voltage for the LEDs. FIG. 3 shows a simplified circuit schematic of the LED driver 10 constructed according to one embodiment of the invention, and FIG. 4 shows a simplified flowchart of controller operation for the LED driver 10. The LED driver 10 may receive alternating current (AC) voltage from an AC voltage source 100, which may include voltage from a utility grid, for example, 230 VAC at 50 Hz. The LED driver 10 may provide direct current (DC) to LEDs, also referred to herein as an LED load 350.

The LED driver 10, as illustrated in FIG. 3, may comprise an AC EMI filter 310, an input rectifier 320, a power-factor-correction converter 330, a DC EMI filter 340, a DC-to-DC converter comprising an LLC converter 360 and an LLC controller 371, a power-factor-correction controller 372, a multiplier 373, an LED controller 374, an isolator 375, and various other electronics and circuit components known in the art. The LLC converter may be a resonant converter that contains two resonant inductors (L) and one capacitor (C) such that one inductor is a series resonant component, the capacitor is a series resonant component, and the second inductor is a parallel resonant component. In some embodiments of the invention, the term "a first controller" may be used herein to describe the LLC controller 371, the power-factor-correction controller 372, and/or the LED controller 374. An example configuration for electrically and/or communicably coupling these components of the LED driver 10 is illustrated in FIG. 3. Although these components are illustrated as including particular switches, diodes, resistors, and the like, other circuit components for achieving the functions described herein may be substituted in the schematic illustrated in FIG. 3 without departing from the scope of the invention.

The AC EMI filter 310 may be configured to reduce high-frequency current from reaching the utility grid 100. The input rectifier 320, receiving input from the AC EMI filter 310, as illustrated in FIG. 3, may comprise diodes D301, D302, D303, and D304. In some embodiments of the invention, some or all of the diodes in input rectifier 320 may be replaced with synchronous MOSFETs. A synchronous MOSFET may be defined herein as a MOSFET that is used as a diode such that when the current flows in the same direction as the MOSFET body diode, the MOSFET is switched on to reduce the voltage drop across it.

As illustrated in FIG. 3, a power train of the power-factor-correction converter 330 may comprise inductor L301, switch S301, diode D305, and film capacitor C301. A power train of the LLC converter 360 may comprise switch S302, switch S303, capacitor C302, transformer TX301, diodes D306 and D307, and non-electrolytic (e.g. ceramic) capacitor C310. The transformer TX301 may also be referred to herein as a first magnetic component comprising an inductance and the switch 301 may be referred to herein as a first controllable switch. In some embodiments of the invention, the LED driver 10 may further include a direct current (DC) bus 12 across the capacitor C310. The transformer TX301, the DC-to-DC converter, and the LED load 350 may be coupled to the DC bus 12. A sense resistor R301 monitors the current at the input of the power-factor-correction converter and a sense resistor R302 monitors the current in the LED load 350. However, these sense resistors could be replaced with other devices known in the art to monitor current such as Hall-effect sense current transducers.

Unlike most prior art LED drivers that encompass power conversion and use electrolytic capacitors for energy storage, the LED driver 10 of the present invention uses a film capacitor. The use of film capacitor C301, as illustrated in FIG. 3, is enabled by certain aspects of the present invention. Specifically, the use of a very high voltage bus at the point of energy storage minimizes the required capacitance (since the energy storage of a capacitor is $CV^2$). Furthermore, the regulation method of the LED driver 10 regulates either the current through the LED or the power in the LED, rather than trying to regulate the voltage across the LED. Additionally, the LED driver 10 of the present invention allows a significant amount of power ripple at double-AC-grid frequency (e.g. 100 Hz or 120 Hz) in the LED load 350. The nature of the LED itself prevents most of the LED power ripple from affecting the ripple across the film capacitor C301 because the LED voltage does not change as significantly with power as other types of loads such as resistive loads.

Figure 5:
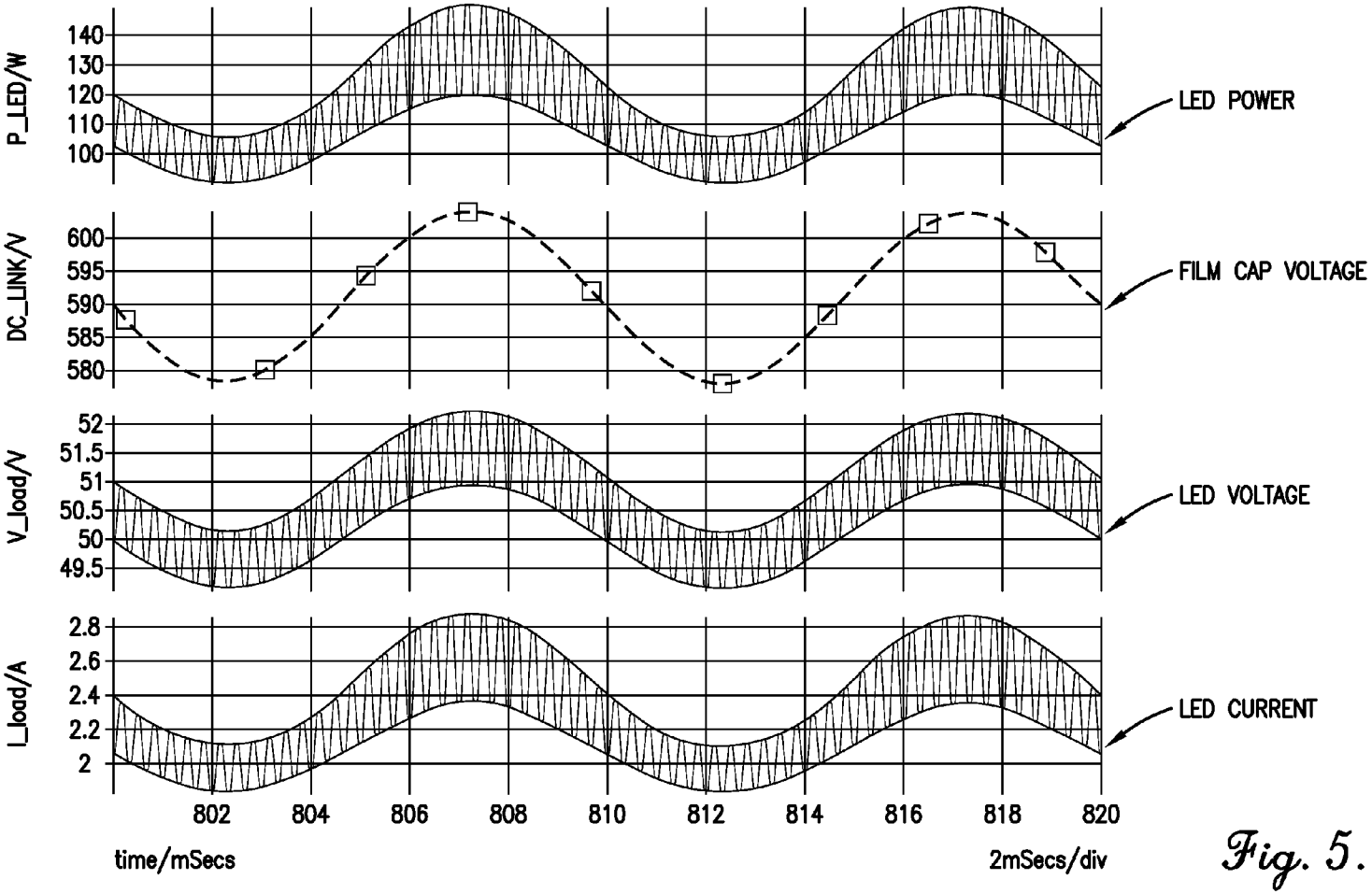
FIG. 5 is a chart illustrating voltage, current, and power ripple in an LED as well as voltage ripple across a film capacitor for the LED driver in FIG. 3.

The above points are illustrated by the curves on the chart in FIG. 5. The curves in FIG. 5 show typical LED voltage, current, and power as well as voltage across the energy storage film capacitor for a typical application of the present invention. As can be seen by the curves in FIG. 5, the LED power has a significant amount of ripple, varying approximately 60% during the ac grid power cycle. The voltage across the film capacitor (labeled "film cap voltage"), on the other hand, only varies about 5%. The voltage across the film capacitor is therefore able to remain below the rating of typical semiconductors while remaining above the peak of the ac grid voltage despite the fact that the capacitance of the film capacitor in a typical embodiment is only approximately 10% of the capacitance of an electrolytic capacitor that would be used in a prior art LED driver.

During normal driver operation, the LLC controller 371 produces fixed duty cycle, fixed frequency gate pulses to switch S302 and switch S303 such that the gate drive pulses of switch S302 and switch S303 are phase shifted 180 degrees from each other. The duty cycle of the pulses is 50% minus a small time period needed for the current in the switches to commutate to the opposing switch. For example, a typical duty cycle would be 48%. The switching frequency of the LLC converter 360 is tuned to operate at frequencies slightly below the natural resonant frequency of the leakage inductance of transformer TX301 and the capacitance of capacitor C302. As a result of operating at resonance, the impedance of capacitor C302 is cancelled by the impedance of the leakage inductance of TX302 and the output voltage of the LLC converter 360 is very tightly coupled to the input voltage of the LLC converter 360. The LLC converter 360 therefore acts as a DC transformer with a turns ratio equal to one-half of the turns ratio of transformer TX301. (The factor of one-half is produced by use of a half-bridge rather than a full-bridge). The LLC converter 360 operates with zero-current switching and close to zero-voltage switching. It therefore operates at very high efficiency (such as 98%). The LLC converter 360 does not regulate the output voltage since the output voltage is always a scaled multiple of the input voltage for the LLC converter 360. The LLC converter 360 provides high-voltage isolation between the LED string and the AC grid 100 and also provides voltage scaling appropriate for the load 350 that is being used. The ratio of double-AC-grid frequency ripple voltage to DC voltage will therefore be the same at the input and the output of the LLC converter 360.

As illustrated in FIG. 3, diode D306, diode D307, and capacitor C310 may be configured to rectify and filter the output of the LLC converter 360. Capacitor C310 may be a non-electrolytic capacitor and would typically be a small multilayer ceramic capacitor such as a 10 microfarad, 63V capacitor. Capacitor C310 may filter some of the high-frequency voltage applied to the LED load 350, but the capacitor is sized small enough that it provides insignificant filtering of the double-AC-grid frequency (e.g. 100 Hz or 120 Hz).

Other non-regulated isolated converters may be used in place of an LLC converter to perform the same functions described herein. For example, a hard-switched half-bridge that is operated at 50% duty cycle and followed by a transformer will perform a similar function. Furthermore, full-bridge versions of these converters perform the same function. Other possibilities will occur to those skilled in the art. What is important is that this converter stage be optimized for high-efficiency design and designed to act as a DC transformer.

LED controller 374 may be configured to monitor the current in the LED load 350 and to send a signal to isolator 375, which gates a pulse-width-modulated signal to multiplier 373 depending on whether the measured current is below or above a predetermined level of current. The predetermined level of current can be easily altered with a dimming signal to provide a dimming function for the LED driver 10. Furthermore, some embodiments of the current invention adjust the predetermined level of current as a function of voltage across the LED load 350 in such a way as to regulate the power into the LED load 350 to a nearly constant level. One low-cost method for producing a nearly constant LED power regardless of LED voltage is to linearly decrease the predetermined LED current as the LED voltage is increased.

Figure 6:
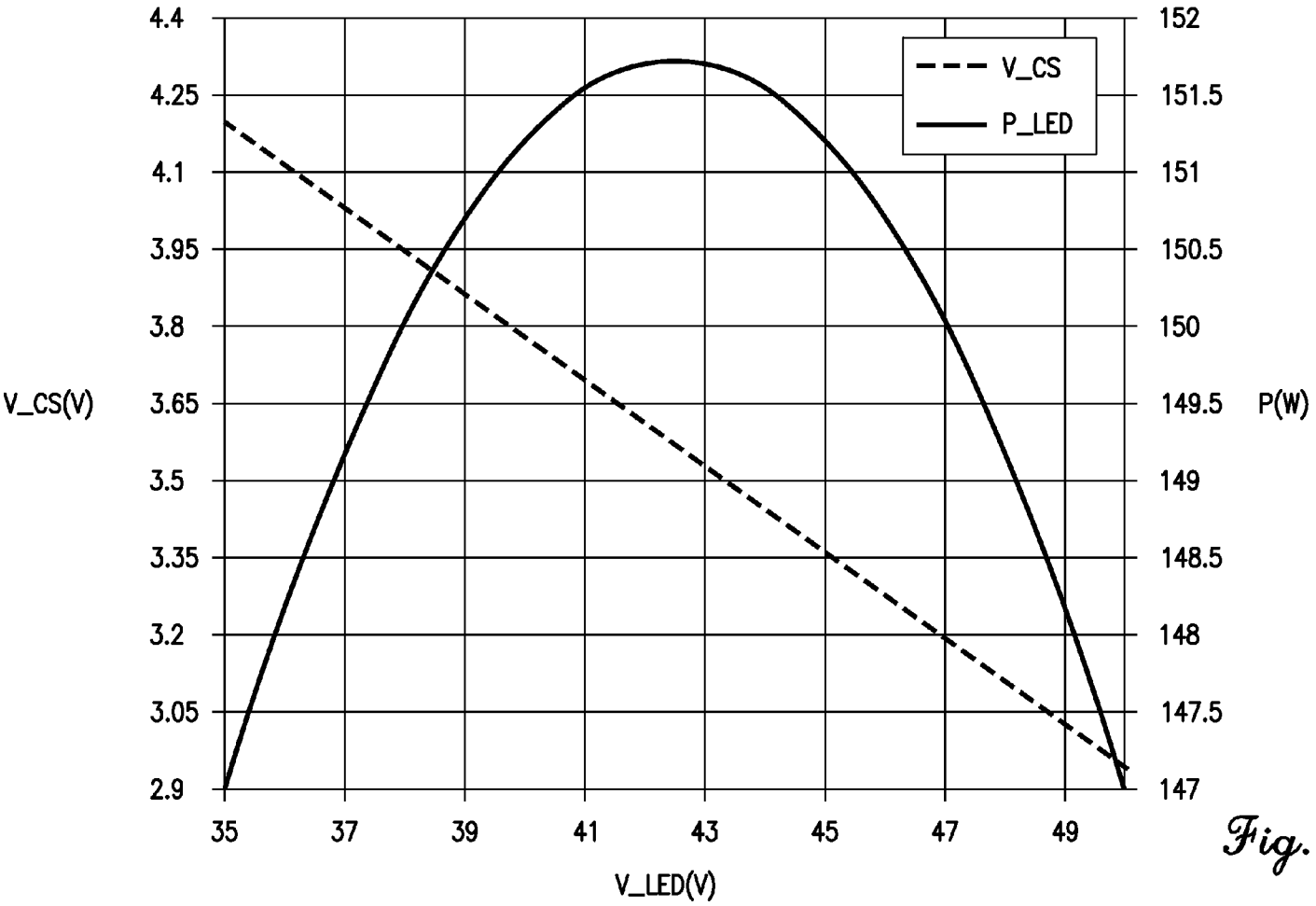
FIG. 6 is a chart illustrating constant output power curves for an embodiment of the present invention.

FIG. 6 provides a chart illustrating a typical example of how the power would vary with current and voltage. The plot in FIG. 6 shows both the LED power and sense resistor current as a function of LED voltage. As the LED voltage changes from 35V to 50V (a 43% change in voltage), the output power remains between 147 W and 152 W or 150 W±1.7%. Thus the output power is approximately constant despite the wide variation in LED voltage. The ability of the converter to provide constant power with a very simple and inexpensive controller provides many advantages. For example, the output power can be made to remain constant despite wide temperature variations which would tend to occur in an outdoor application. Furthermore, the output power can be made the same from one product to another despite variations in LED voltage tolerance.

Referring again to FIG. 3 and FIG. 4, after the LED controller 374 determines whether or not the current through resistor R302 is above or below a predetermined level, that information may be sent to isolator 375 to decrease or increase multiplier 373 input, respectively. For the embodiment illustrated in FIG. 3, a voltage across a secondary of LLC transformer TX301 provides a high-frequency voltage that is used for a signal to send across isolation transformer TX302; however, an independent high-frequency signal could alternatively be used. The embodiment illustrated in FIG. 3 has the advantage that no additional components are required to generate a high-frequency signal. The LED controller 374 uses switch S304 to gate the high-frequency signal from transformer TX301. In practice, switch S304 can be a semiconductor switch. Capacitor C304 blocks the DC component of the high-frequency signal from being transferred to transformer TX302. When switch S304 is closed, the pulse-width-modulation signal from the secondary passes through to the multiplier. When switch S304 is open, the pulse-width-modulated signal from the secondary is blocked from passing through to the multiplier. The multiplier can simply gate the sine wave signal at resistor R313 based on the pulse-width-modulation signal and then filter with a capacitor that blocks the high-frequency pulse-width-modulation frequency, but passes the low frequency of the power grid. Thus an inexpensive method is provided for producing a multiplier. Furthermore, this inexpensive method does not require the use of an optocoupler or any other optical component. Another variant of this inexpensive multiplier can use the duty cycle of the pulse-width-modulation signal to increase or decrease the multiplicand by increasing the duty cycle when the LED current is below a predetermined level and decreasing the duty cycle when the LED current is above a predetermined level.

In the embodiment of the invention illustrated in FIG. 3, resistors R311, R312, and R313 provide a rectified sinusoidal reference that is proportional to the grid voltage amplitude. This reference is fed into multiplier 373. Also, the pulse-width-modulation signal from the secondary or output side of the LED driver is fed into multiplier 373. In general, an input voltage side of the LED driver is referred to herein as the "primary" side and the output voltage side of the LED driver is referred to herein as the "secondary" side. The output of the multiplier is therefore a rectified sine wave synchronized to the grid voltage and which has amplitude that can be increased or decreased by the LED controller 374 as needed to hold the LED current to a predetermined level.

Figure 7:
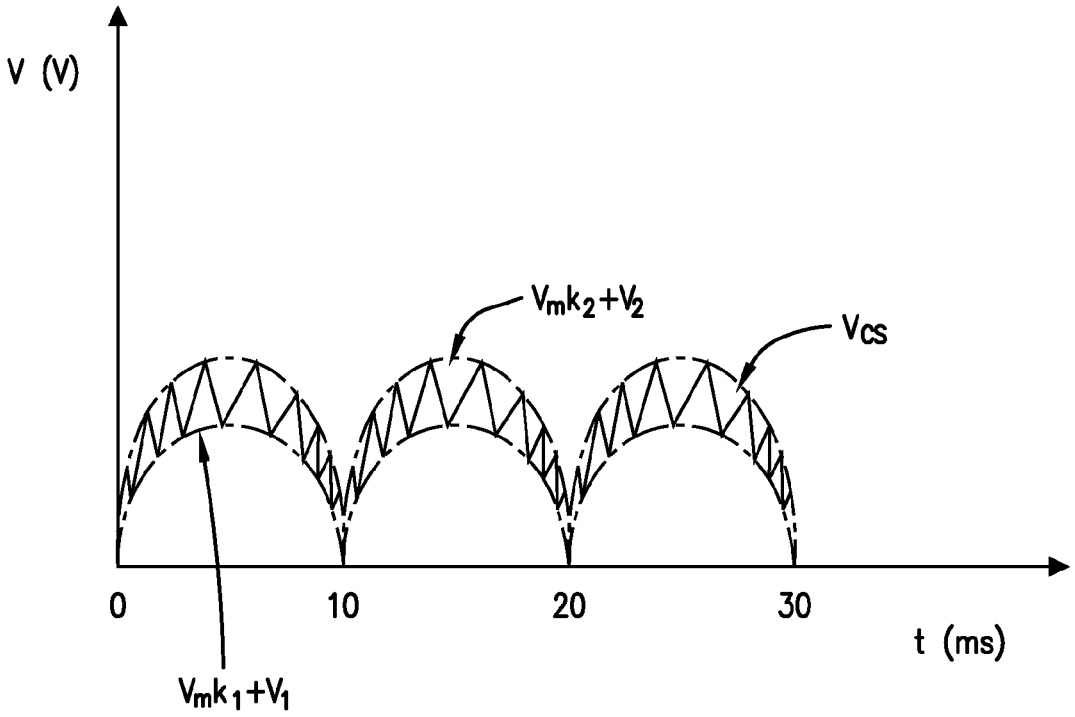
FIG. 7 is a chart illustrating voltage waveforms for a power-factor-correction controller for an embodiment of the present invention.

The power-factor-correction controller 372 uses the output of the multiplier 373 with two scaling factors and two offset factors to provide upper and lower boundaries for the power-factor-correction current. As illustrated in FIG. 4, the multiplier output $V_m$ is scaled by factors $k_1$ and $k_2$ and then offset by voltages $V_1$ and $V_2$, respectively. When the voltage across sense resistor R301 exceeds the upper threshold $V_m k_2+V_2$, S301 is turned off. When the voltage across sense resistor R301 is below the lower threshold $V_m k_1+V_1$, S301 is turned on. The net result of the current (and proportionally the sense-resistor voltage $V_{CS}$) is shown in FIG. 7.

There are several benefits to the operation of the power-factor-correction controller 372 compared to standard methods of operation of power-factor-correction controllers including the following: 1) Provided that $k_2$ is larger than $k_1$ (which would be the recommended way to operate the converter), the frequency will be lower and the ripple will be higher at the peak of the ac grid than at the zero-crossings. This causes lower losses and lower total harmonic distortion than continuous-conduction-mode constant frequency operation. 2) The ripple is significantly lower than the instantaneous value of the ac grid current. This means that losses and total harmonic distortion will be much lower than would be the case for critical-conduction-mode operation. 3) The total harmonic distortion and losses can easily be traded by adjusting the $k_1$, $k_2$, $V_1$, and $V_2$. Whereas with critical-conduction-mode operation, no parameters can be controlled except through inductance value and continuous-conduction-mode only allows control of the constant switching frequency. 4) The frequency is lowest when the amplitude of the current is highest. Thus the EMI generated is lower than for the continuous-conduction-mode method which has a constant frequency. Also, since the amplitude of the current is significantly lower than for the critical-conduction-mode method, the EMI generated is also significantly lower than for the critical-conduction-mode method. The proposed method of controlling the power-factor-correction converter is therefore advantageous compared with traditional methods of control in regards to efficiency, total harmonic distortion, EMI, and ability to easily trade off total harmonic distortion with efficiency.

The LED driver 10 illustrated in FIG. 3 allows for easy addition of a dimming function to the LED driver 10. In constant current operation, the voltage across the sense resistor R302 is compared with a predetermined value to determine whether to allow pulse-with-modulation signal from the secondary to be gated to the multiplier. If a standard 0-10V dimming signal (not shown in the figure) was required to provide a dimming function, one need only scale the predetermined current level with the dimming signal to provide a dimming function.

Further efficiency and cost benefits can be realized by designing the inductance of L301 to significantly vary with load. For example, L301 can be designed to decrease in inductance to only 70% of its value or less when the load increases from 10% load to full load. The increase in inductance at small loads will also cause the ripple at the zero-crossings of the AC grid cycle to decrease compared with the ripple at the grid peaks, thus reducing total harmonic distortion and reducing switching frequency near the zero-crossings. The decrease in switching frequency near the zero-crossings will also decrease the losses.

Figure 8:
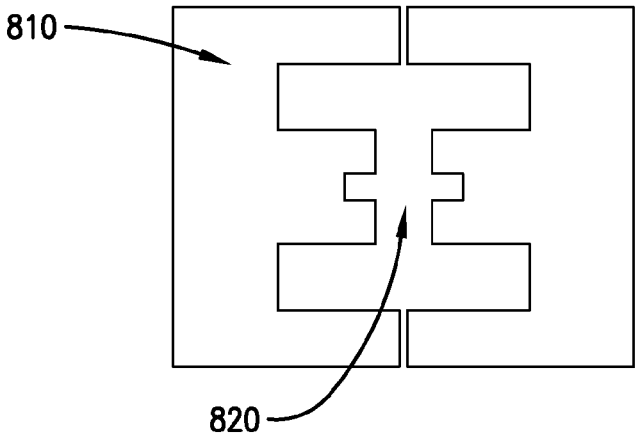
FIG. 8 is a schematic drawing of an inductor utilized in some embodiments of the present invention.

In practice, there are many known methods of designing an inductor (e.g., L301 in FIG. 3) to have significantly lower inductance at high load than at low load. One such method is a stepped air gap as illustrated in a drawing of the core shown in FIG. 8. The inductor core 810 illustrated in FIG. 8 may use an E-E core. The stepped air gap 820 causes saturation at some mid-level of current so the air gap effectively increases for high values of current.

In another alternative embodiment of the present invention, two or more DC-to-DC converters (such as the LLC converter 360 described above) may be coupled to the film capacitor C301. For example, each DC-to-DC converter transformer may be matched to the specific LED string that needs to be driven by that transformer. Furthermore, in this alternative embodiment of the invention, the LED controller 374 may be duplicated for each DC-to-DC converter. The function of the switch S304 may then be changed to an "AND" function from all of the DC-to-DC converters. That is, if any of the LED strings reaches or exceeds their corresponding predetermined level of current, the pulse-width-modulation signal input of multiplier 373 may be disabled, whereas if none of the LED strings exceed their corresponding predetermined level of current, the pulse-width-modulation signal may be enabled.

In an alternative embodiment of the multiplier (not shown), the pulse-width-modulation signal on the secondary can be gated to charge or discharge a capacitor on the primary side of the circuit. The capacitor voltage can then be multiplied by the sinusoidal reference signal voltage through use of a junction gate field-effect transistor (JFET) or other multiplier.

Advantageously, the LED driver 10 described herein can make use of a non-electrolytic capacitor as its main storage element (so that it can have a long lifetime and high reliability operating at high temperatures for outdoor applications). Furthermore, the LED driver 10 can operate at high efficiency and may have an inexpensive feedback loop that does not use optical components. Of further benefit is the power-factor-correction controller 372 described herein, which reduces harmonic distortion, spreads the EMI noise across many frequencies, and allows use of an inexpensive controller.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A light emitting diode (LED) driver comprising:

a first magnetic component configured to be coupled to an alternating current (AC) power source, wherein the first magnet component comprises an inductance;

a first controllable semiconductor switch coupled to the inductance;

a direct current (DC) bus coupled to the inductance and comprising a film capacitor;

an LED load comprising a string of LEDs coupled to the DC bus;

a non-regulated, isolated DC-to-DC converter that functions as a DC transformer and that is coupled to the DC bus and to the string of LEDs; and a first controller configured to control the first controllable semiconductor switch in such a way as to draw a sinusoidal current from the AC power source and such that the film capacitor absorbs pulsating power from the power source and provides DC power to the string of LEDs, wherein the film capacitor is sized such that a peak-to-peak AC ripple power in the LED load is greater than 20% of a steady-state power in the LED load, wherein a ratio of ripple voltage at a double AC-power-source frequency across the film capacitor to a DC voltage across the film capacitor is the same as a ratio of ripple voltage at a double AC-power-source frequency across the string of LEDs to a DC voltage across the string of LEDs.

2. The LED driver of claim 1, wherein the DC-to-DC converter is an LLC converter.

3. The LED driver of claim 1, wherein the first controller produces a first signal and a second signal, wherein the first signal and second signal are rectified sinusoids with a DC offset and are in phase with each other such that the amplitude of the first signal is less than or equal to the amplitude of the second signal and the sinusoidal portion of the second signal divided by the sinusoidal portion of the first signal is a constant over a course of each half-cycle of the AC power source, wherein the first controller compares a current flowing in the first magnetic component to the first signal and the second signal to determine whether to turn on the first controllable semiconductor switch in such a way as to either decrease or increase current through the first magnetic component, and in such a way as to produce a varying pulse-width-modulation frequency which decreases as an instantaneous value of the current increases and which produces a value of AC ripple current which is smaller than the instantaneous value of the AC current.

4. The LED driver of claim 1, wherein the first controller monitors current in the LED string and regulates current drawn by the AC power source to maintain a first predetermined current level in the string of LEDs.

5. The LED driver of claim 4, further comprising a second DC-to-DC converter coupled to the DC bus, wherein the second DC-to-DC converter is further coupled to a second string of LEDs, the current in the second string of LEDs being regulated to a second predetermined level via a second controller, wherein the second DC-to-DC converter is an unregulated DC-DC converter operated as a DC transformer.

6. The LED driver of claim 5, further comprising a multiplier which multiplies a reference sinusoidal signal by a multiplicand, wherein the multiplicand changes at a slow rate compared with the frequency of the AC power source and the multiplicand is increased when both current in the first string of LEDs is below the first predetermined current level and current in the second string of LEDs is below the second predetermined current level, wherein the multiplicand is decreased when either the current in the first string of LEDs is above the first predetermined level of current or the current in the second string of LEDs is above the second predetermined level of current.

7. The LED driver of claim 5, further comprising a multiplier which multiplies a reference sinusoidal signal by a pulse-width-modulation signal from at least one of the first controller and the second controller, wherein the pulse-width-modulation signal is gated ON when current in the first string of LEDs is below the first predetermined current level and current in the second string of LEDs is below the second predetermined level, and the pulse-width-modulation signal is gated OFF when the current in the first string of LEDs is above the first predetermined current level or the current in the second string of LEDs is above the second predetermined level.

8. The LED driver of claim 1, wherein a single-AC-power-cycle average value of inductance of the first magnetic component changes with the LED load such that an average inductance value when operating at full load is less than 70% of an average inductance value when operating at 10% load.

9. The LED driver of claim 8, wherein the first magnetic component comprises a core that contains a stepped air gap.

10. A light emitting diode (LED) driver comprising:

a first magnetic component configured to be coupled to an alternating current (AC) power source, wherein the first magnet component comprises an inductance;

a first controllable semiconductor switch coupled to the inductance;

a direct current (DC) bus coupled to the inductance and comprising a film capacitor;

an LED load comprising a string of LEDs coupled to the DC bus; and a first controller configured to control the first controllable semiconductor switch in such a way as to draw a sinusoidal current from the AC power source and such that the film capacitor absorbs pulsating power from the power source and provides DC power to the string of LEDs, wherein the first controller monitors current in the LED string and regulates current drawn by the AC power source to maintain a first predetermined current level in the string of LEDs, further comprising a multiplier which multiplies a reference sinusoidal signal by a pulse-width-modulation signal.

11. The LED driver of claim 10, wherein the pulse-width-modulation signal is gated ON when the current in the string of LEDs is below the first predetermined current level and the pulse-width-modulation signal is gated OFF when the current in the string of LEDs is above the first predetermined current level.

12. The LED driver of claim 10, wherein the duty cycle of the pulse-width-modulation signal is increased when the current in the string of LEDs is below the first predetermined current level and the duty cycle of the pulse-width-modulation signal is decreased when the current in the string of LEDs is above the first predetermined current level.

13. The LED driver of claim 10, further comprising a first transformer configured to transmit a first signal across a high-voltage isolation boundary, wherein the first signal provides information about the comparison between the first predetermined current level and the current of the string of LEDs.

14. A light emitting diode (LED) driver comprising:

a first magnetic component configured to be coupled to an alternating current (AC) power source, wherein the first magnet component comprises an inductance;

a first controllable semiconductor switch coupled to the inductance;

a direct current (DC) bus coupled to the inductance and comprising a film capacitor;

an LED load comprising a string of LEDs coupled to the DC bus; and a first controller configured to control the first controllable semiconductor switch in such a way as to draw a sinusoidal current from the AC power source and such that the film capacitor absorbs pulsating power from the power source and provides DC power to the string of LEDs, wherein the first controller monitors current in the LED string and regulates current drawn by the AC power source to maintain a first predetermined current level in the string of LEDs, wherein the first controller adjusts the first predetermined current level as a function of voltage across the string of LEDs in such a way as to cause power in the string of LEDs to remain constant when the voltage across the string of LEDs changes.

15. The LED driver of claim 14, wherein the first controller linearly reduces the first predetermined current level according to an increasing of the voltage across the string of LEDs.

* * * * *